US007443361B2

(12) United States Patent
Haynes et al.

(10) Patent No.: US 7,443,361 B2
(45) Date of Patent: Oct. 28, 2008

(54) FRANGIBLE ANTENNA MOUNT

(75) Inventors: Clark Haynes, Tulalip, WA (US); Adam Eby, Mechanicsville, IA (US)

(73) Assignee: Intermec IP Corp., Everett, WA (US)

( * ) Notice: Subject to any disclaimer, the term of this patent is extended or adjusted under 35 U.S.C. 154(b) by 0 days.

(21) Appl. No.: 11/566,189

(22) Filed: Dec. 1, 2006

(65) Prior Publication Data

US 2007/0182661 A1 Aug. 9, 2007

(51) Int. Cl.
*H01Q 1/12* (2006.01)

(52) U.S. Cl. ..... 343/878; 343/880

(58) Field of Classification Search ..... 343/878, 343/880, 882, 900, 901, 715
See application file for complete search history.

(56) References Cited

U.S. PATENT DOCUMENTS

| | | | | |
|---|---|---|---|---|
| 1,085,505 | A | | 1/1914 | Stafford |
| 2,144,038 | A | | 1/1939 | Trump |
| 2,283,607 | A | | 5/1942 | Ludwig |
| 2,419,611 | A | | 4/1947 | Walsh |
| 2,493,787 | A | | 1/1950 | Torretti |
| D158,122 | S | | 4/1950 | Pennington |
| 2,667,317 | A | | 1/1954 | Trebules |
| 3,254,344 | A | * | 5/1966 | Rohrs ..... 343/901 |
| 3,626,421 | A | | 12/1971 | Santana et al. |
| 3,760,423 | A | * | 9/1973 | Kuecken ..... 343/715 |
| D231,536 | S | | 4/1974 | Finke et al. |
| 4,163,981 | A | | 8/1979 | Wilson |
| 4,255,735 | A | | 3/1981 | Liautaud |
| 4,364,051 | A | * | 12/1982 | Yamashita ..... 343/715 |
| 4,725,395 | A | | 2/1988 | Gasparaitis et al. |
| 4,872,017 | A | | 10/1989 | White |
| 4,914,450 | A | | 4/1990 | Dilley et al. |
| D320,603 | S | | 10/1991 | Jones |
| 5,218,369 | A | * | 6/1993 | Jennings ..... 343/702 |
| 5,229,784 | A | | 7/1993 | Jones |
| D357,922 | S | | 5/1995 | Nysether et al. |
| H001588 | H | * | 9/1996 | Arney ..... 343/715 |
| 6,015,139 | A | | 1/2000 | Weber |
| 6,237,268 | B1 | | 5/2001 | Levin |
| D463,250 | S | | 9/2002 | Valentz |

* cited by examiner

*Primary Examiner*—Hoang V Nguyen
(74) *Attorney, Agent, or Firm*—Seed IP Law Group PLLC

(57) ABSTRACT

An antenna mount includes a base, a mounting member and a resilient member extending between the mounting member and the base. The resilient member may be removably coupled to the base via a first coupling member and/or coupled to the antenna mount via a second coupling member. The coupling members and the resilient member are configured to release or disengage in response to a force and/or torque exceeding a threshold force and/or torque.

15 Claims, 6 Drawing Sheets

FRANGIBLE ANTENNA MOUNT

BACKGROUND OF THE INVENTION

1. Field of the Invention

The present disclosure generally relates to support mounts, and more particularly, but not exclusively, to a frangible mount for supporting automatic data collection (ADC) equipment, for example an antenna to transmit and/or read information stored in a Radio Frequency Identification (RFID) device.

2. Description of the Related Art

Businesses, governments and other entities are increasingly using ADC devices to automate the handling of items such as packages, goods, animals and people. ADC systems typically employ one or more readers that are operated to read information from one or more data carriers. For example, one type of ADC system employs one or more machine-readable symbol readers to optically read information from machine-readable symbols (e.g., barcode symbols, stack code symbols, area or matrix code symbols). Another type of ADC system employs one or more RFID readers or interrogators to wirelessly read information from RFID devices commonly referred to as RFID tags or cards. Such RFID readers typically include one or more antennas that emit a read or interrogation signal and that receive a signal in response from an RFID transponder circuit carried by the RFID tag or card. Such signals typically have frequencies or wavelengths in the radio or microwave portions of the electromagnetic spectrum, however such is not limiting.

In many instances, at least the antennas, and in some environments the readers, need to be supported in an exposed position. For example, an antenna and/or reader may be attached to an exterior of a vehicle, for example a forklift or tug. Also for example, an antenna and/or reader may be attached proximate a portal between which goods, packaging, or entities carrying RFID tags or cards pass. Also for example, an antenna and/or reader may be attached to a wall, pillar or other structure in an environment, for example a warehouse.

While potentially enhancing reception, such exposure subjects the antenna and/or readers to possible damage. For example, forklifts and tugs often operate in highly confined spaces. It is common for forklifts and tugs to strike walls, pillars or other objects in such confined spaces. Such may cause a vehicle mounted antenna and/or reader to be torn from the vehicle. Such may cause a portal, wall, pillar or other support structure mounted antenna and/or reader to be torn from the support structure.

RFID systems are typically very costly. Damaged elements are not only costly to replace, but replacement may take time, adversely effecting the entities operations.

Accordingly, there is a need for a low cost antenna mount that minimizes damage to ADC equipment such as antenna and/or reader, and that is easily repairable.

BRIEF SUMMARY OF THE INVENTION

In one aspect, an antenna mount comprises a base; a mounting member to support an antenna; a resilient member having a first end and a second end, the resilient member physically coupled to the mounting member proximate the first end of the resilient member; and a coupling member physically coupled to the base and physically coupled to the resilient member proximate the second end of the resilient member, wherein the resilient member temporarily deforms in response to a force applied to the mounting member and the coupling member releases the resilient member from the base in response to the force applied to the mounting member being greater than a threshold force.

In another aspect, an antenna mount comprises a base; an antenna; and coupling means for resiliently and releasably coupling the antenna to the base.

In yet another aspect, a method of mounting an antenna to an object carrying a base comprises: attaching a mounting member to a resilient member proximate one end of the resilient member such that the resilient member temporarily deforms in response to a force applied to the mounting member; attaching the resilient member to a coupling member proximate another end of the resilient member; attaching the resilient member to a portion of a coupling member proximate another end of the resilient member; adjustably attaching the coupling member to the base such that the coupling member releases the resilient member from the base in response to the force applied to the mounting member being greater than a threshold force; and attaching an antenna to the mounting member.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with systems and methods for mounting objects such as antennas have not been shown or described in detail to avoid unnecessarily obscuring descriptions of the embodiments.

Unless the context requires otherwise, throughout the specification and claims which follow, the word "comprise" and variations thereof, such as "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1:
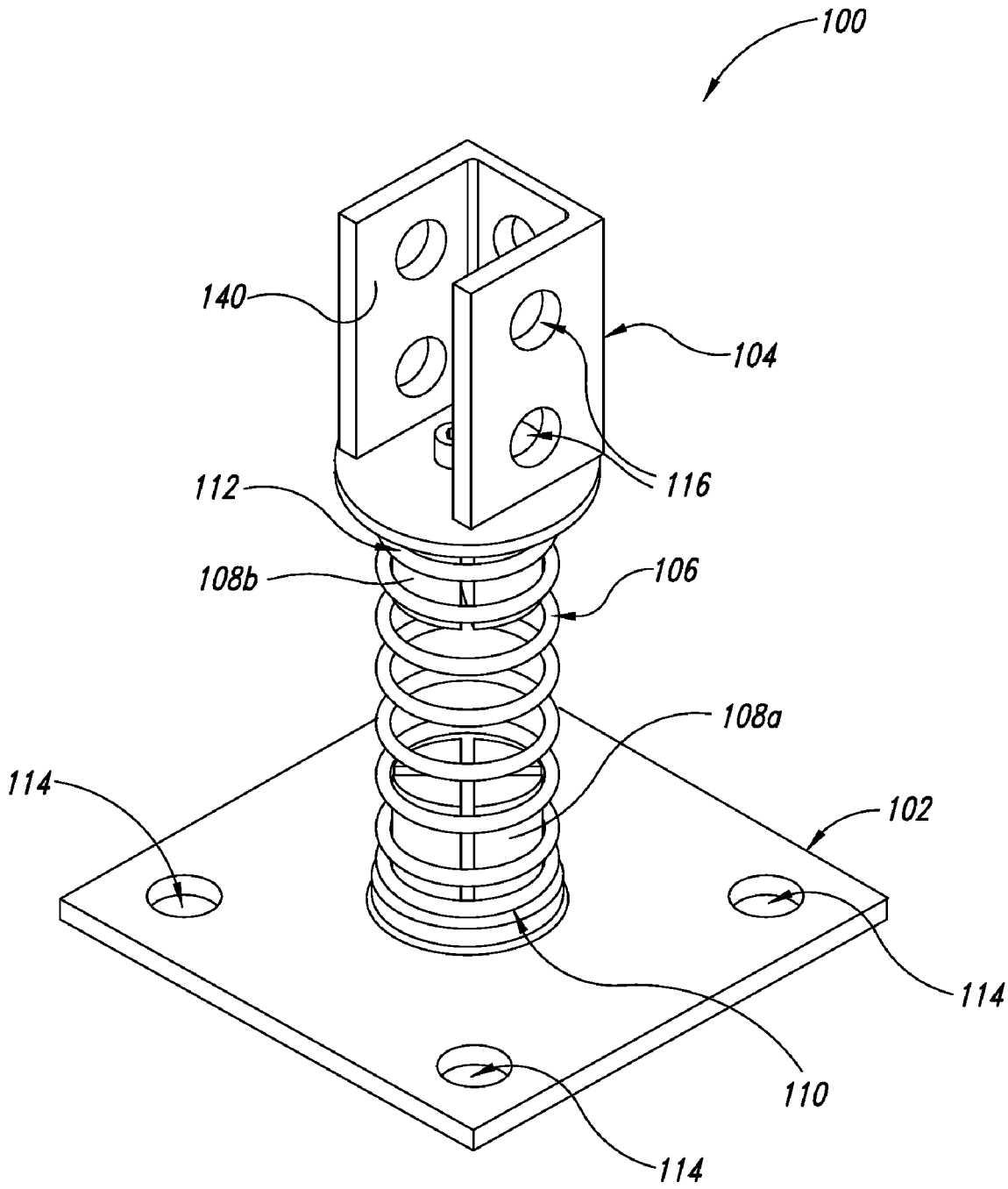
FIG. 1 is an isometric view of an antenna mount according to one illustrated embodiment.

FIG. 1 shows an antenna mount 100 according to one illustrated embodiment.

The antenna mount 100 includes a base 102, a mounting member 104, and a resilient member 106 that extends between the base 102 and the mounting member 104. The antenna mount further includes a pair of adjustable coupling members, collectively referenced as 108 and individually referenced as 108*a* and 108*b*. A first end 110 of the resilient member 106 is releasably coupled to the coupling member 108*a*, and a second end 112 of the resilient member 106 is releasably coupled to the coupling member 108*b*.

The adjustable coupling members 108 and the resilient member 106 are configured to couple via frictional engagement between the adjustable coupling members 108 and the resilient member 106. In response to a torque or a force that is greater than a threshold torque or force, the resilient member 106 may uncouple from either the first adjustable coupling member 108*a* or the second adjustable coupling member 108*a* or from both adjustable coupling members 108. The frictional engagement between the first adjustable coupling member 108*a* and the resilient member 106 can be varied by adjustments to the adjustable coupling member 108*a*. When the frictional engagement between the first adjustable coupling member 108*a* and the resilient member 106 is increased, the threshold force or torque required to disengage the resilient member 106 from the first adjustable coupling member 108*a* increases. Similarly, when the frictional engagement between the first adjustable coupling member 108*a* and the resilient member 106 is decreased, the threshold force or torque required to disengage the resilient member 106 from the first adjustable coupling member 108*a* decreases. The second adjustable coupling member 108*b* is configured similar to the first coupling member 108*a*, and consequently, the amount of frictional engagement between the second adjustable coupling member 108*b* and the resilient member 106 can be increased or decreased. The second adjustable coupling member 108*b* is independent of the first adjustable coupling member 108*a*, and consequently, the adjustable coupling members 108*a* and 108*b* can be adjusted to release from the resilient member 106 at different threshold forces or threshold torques or at the same threshold force or threshold torque.

In some embodiments, the antenna mount 100 may include just one of the adjustable coupling members 108. The resilient member 106 may be rigidly affixed to the base 102 and removably coupled to the mounting member 104 via the adjustable coupling member 108*b*, or the resilient member 106 may be removably coupled to the base 102 via the adjustable coupling member 108*a* and rigidly affixed to the mounting member 104.

The resilient member 106 can comprise any shape, feature, component, or material, that temporarily deforms in response to an applied force and returns to its relaxed state e.g., normal shape and orientation, after the force is no longer applied to the resilient member 106. The force can be applied to the resilient member 106 either directly and/or indirectly. For example, an indirect force may be applied to the mounting member 104, and the force and/or a torque is transferred to the resilient member 106 via the mounting member 104.

In one embodiment the resilient member 106 may comprise a spring, such as a coil spring. Additionally, or alternatively, the resilient member 106 may include other features and/or materials that contribute to the resiliency of the resilient member 106. For example, the resilient member 106 may include a cylindrical silicone member with a flexible core, such as an elongated member fabricated from metal, composites, and/or hardened plastics.

The base 102 can be fabricated from any material capable of securely fastening the base 102 to a surface. For example, the base 102 can be fabricated from metals such as aluminum, titanium, or steel, composites such as carbon fiber, reinforced polymers, or hardened or reinforced fiberglass, plastics, woods, reinforced silicone, hardened or reinforced foams, any combination thereof.

Figure 6:
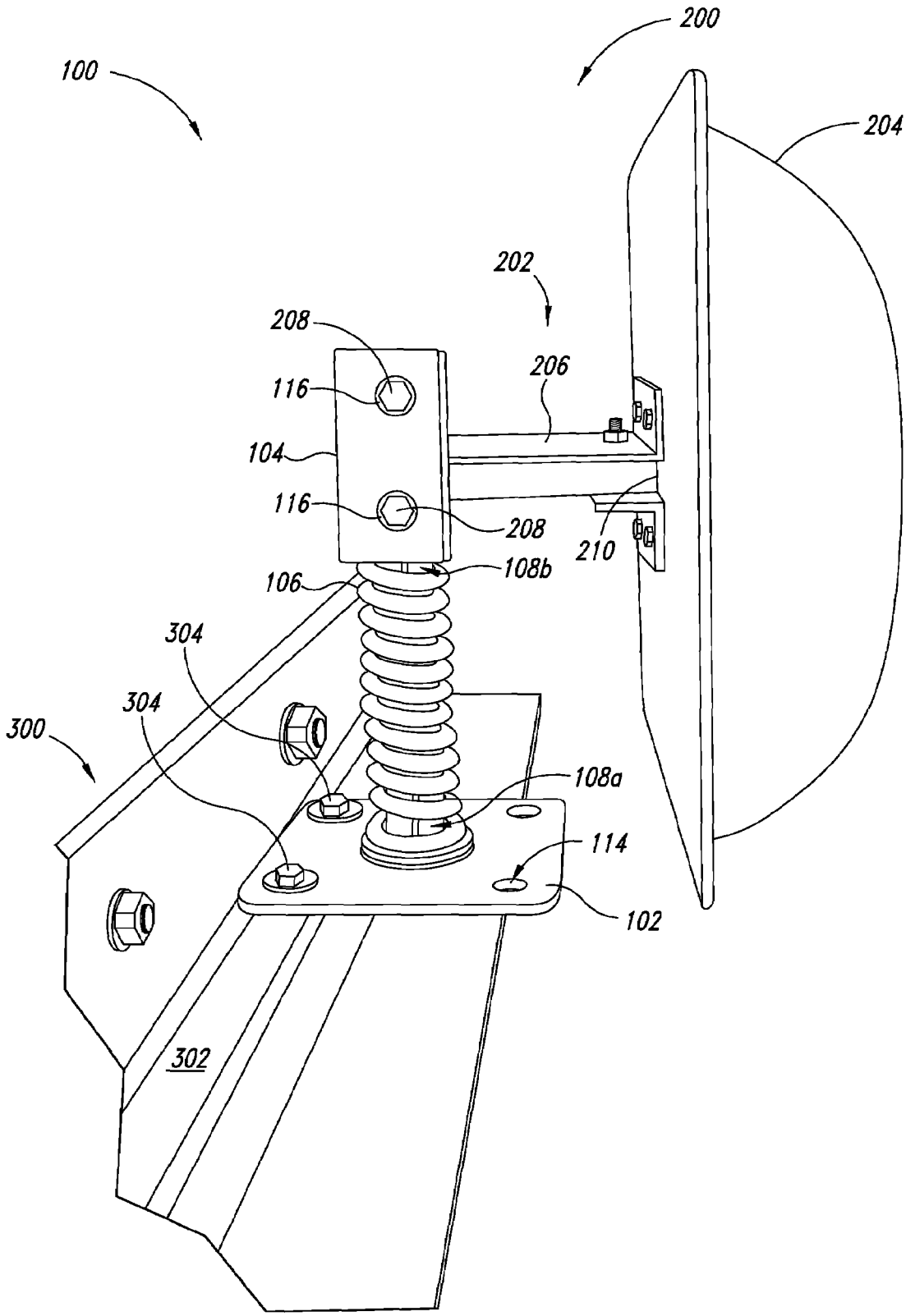
FIG. 6 is an isometric view of an antenna mount and an antenna according to one illustrated embodiment.

The base 102 comprises at least one coupling feature 114 for coupling the base to a surface 302 (see FIG. 6). The coupling feature 114 is illustrated as hole that may receive a fastener such as a bolt or screw (not shown). The coupling features 114 are illustrated as holes only for the sake of clarity. Other non-limiting coupling features include, but are not limited to, adherers such as adhesives or removable adherers such as hook and loop fasteners, clasps, rivets, and shaped structures configured to be received by complimentarily shaped structures.

The mounting member 104 may comprise any shape amenable to coupling with an antenna assembly 200 (see FIG. 6). In some embodiments, the mounting member 104 may comprise a strut having at least one coupling feature 116 to couple with the antenna assembly 200. The coupling features 116 are illustrated as holes, but this is done merely for the sake of clarity. In other embodiments, the coupling features 116 may comprise, a railing, an adherer including adhesives and removable adherers such as hook and loop fasteners, or any other feature that may receive a fastener or a complementing portion of the target antenna.

The mounting member 104 can be fabricated from any material capable of withstanding loads imposed on the mounting member 104 by the antenna assembly 200 (see FIG. 6). For example, the mounting member 104 can be fabricated from metals such as aluminum, titanium, or steel, composites such as carbon fiber, reinforced polymers, or hardened or reinforced fiberglass, plastics, woods, reinforced silicone, hardened or reinforced foams, any combination thereof, or any other material that can maintain a shape and resist loads imposed by a weight of the antenna assembly 200 (see FIG. 6) and/or by other forces imposed by an impact from an object to the antenna or the antenna mount.

Figure 2:
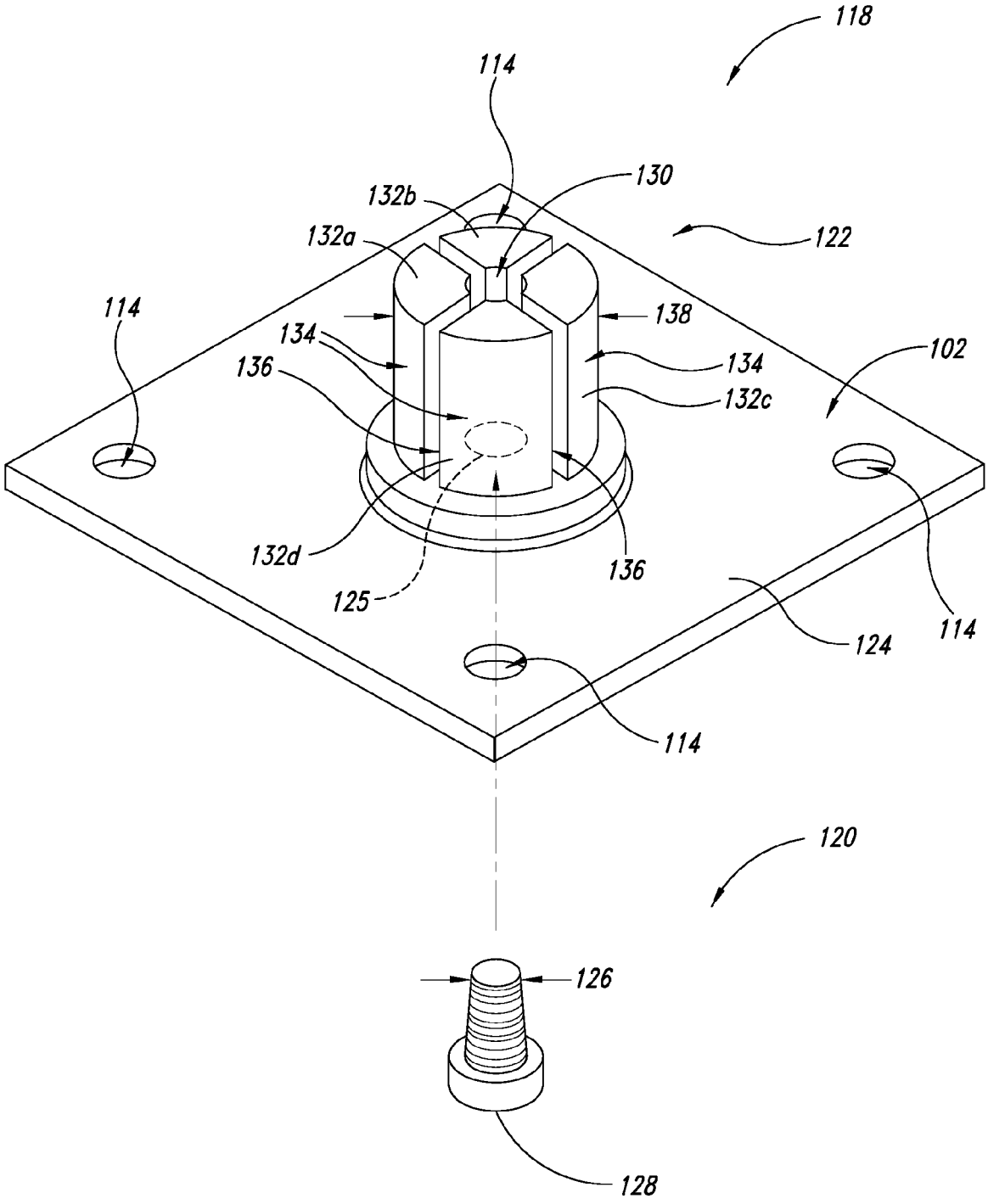
FIG. 2 is an isometric view of a coupling member and the base of FIG. 1 according to one illustrated embodiment.

FIG. 2 shows the base 102 and the coupling member 108*a* of FIG. 1 according to one illustrated embodiment. In this embodiment, the coupling member 108*a* comprises an expansion fastening assembly 118 having an adjustable fastener 120 and an expandable sleeve 122. The base 102 comprises a plate 124 having a hole 125 formed therethrough. The expandable sleeve 122 is rigidly affixed to the plate 124. In some embodiments, the expandable sleeve 122 may be welded or adhered to the plate 124.

In some embodiments, the adjustable fastener 120 is tapered along a longitudinal axis thereof such that and the outer diameter 126 of the adjustable fastener 120 is largest at a head end 128 and decreases distal from the head end 128. In some embodiments, the adjustable fastener 120 may be a tapered bolt or screw or the like.

The expandable sleeve 122 is generally cylindrical in shape and includes a receptacle 130 and multiple elongated members. The receptacle 130 is aligned with the opening 125 formed in the plate 124.

In the embodiment illustrated in FIG. 2, the expandable sleeve 122 includes four elongated members, which are individually referenced as 132*a*-132*d* and collectively referenced as 132, but in other embodiments, the number of elongated members may two or three or more than four. Each one of the elongated members 132 defines an outer surface 134. The expandable sleeve 122 has a variable diameter 138. The elongated members 132 are arranged such that slots 136 extend between the elongated members 132. The slots 136 extend from the outer surface 134 to the receptacle 130.

In some embodiments, the receptacle 130 and the adjustable fastener 120 have complementary threads and dimensions. In some embodiments, the receptacle 130 defines a diameter (not shown) that is smaller than at least the largest diameter 126 of the adjustable fastener 120, i.e., the diameter 126 of the adjustable fastener 120 proximal to the head end 128. The adjustable fastener 120 is inserted into the hole 125 and penetrates the receptacle 130. The adjustable fastener 120 penetrates receptacle 130 and engages the elongated members 132. The adjustable fastener 120 pushes the elongated members 132 outward from the receptacle 130, thereby expanding the expandable sleeve 122. A depth of penetration of the adjustable fastener 120 in the receptacle 130 determines the amount of force the surface 134 of the expandable sleeve 122 exerts on the resilient member 106. Consequently, the force between the expandable sleeve 122 and the resilient member 106 is adjustable by a user. Since the force between the expandable sleeve 122 and the resilient member 106 contributes to a frictional engagement therebetween, adjusting this force will also impact the threshold force at which the coupling member 108*a* releases the resilient member 106. Accordingly, the threshold force at which the coupling member 108*a* releases the resilient member 106 is also adjustable.

Figure 3:
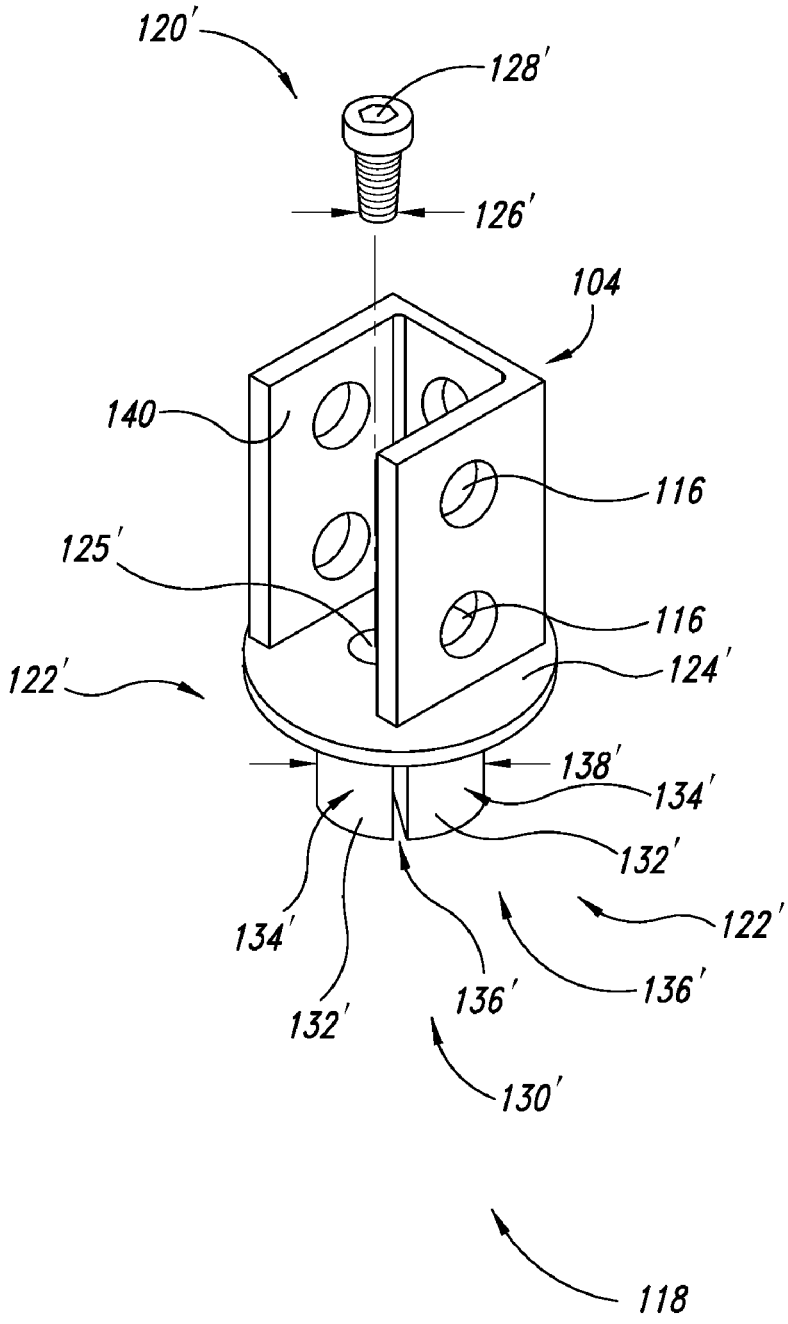
FIG. 3 is an isometric view of a coupling member and the mounting member of FIG. 1 according to one illustrated embodiment.

FIG. 3 shows the mounting member 104 and the coupling member 108*b* of FIG. 1 according to one illustrated embodiment. In FIG. 3, the various labels having a both a reference numeral and a prime (') identify similar components and/or features as those of FIG. 2 that are labeled with the same reference numeral. The detailed description of such components are initially provided with respect to the embodiment of FIG. 2 and for the sake of brevity the description of such components in the context of their subsequently prime-labeled counterparts in FIG. 3 are abbreviated or omitted.

In this embodiment, the coupling member 108*b* comprises an expansion fastening assembly 118' having an adjustable fastener 120' and an expandable sleeve 122'. The mounting member 104 comprises a U-shaped channel 140 affixed to a plate 124' having a hole 125' formed therethrough. The expandable sleeve 122' is rigidly affixed to the plate 124'. In some embodiments, the expandable sleeve 122' may be welded or adhered to the plate 124'.

Figure 4:
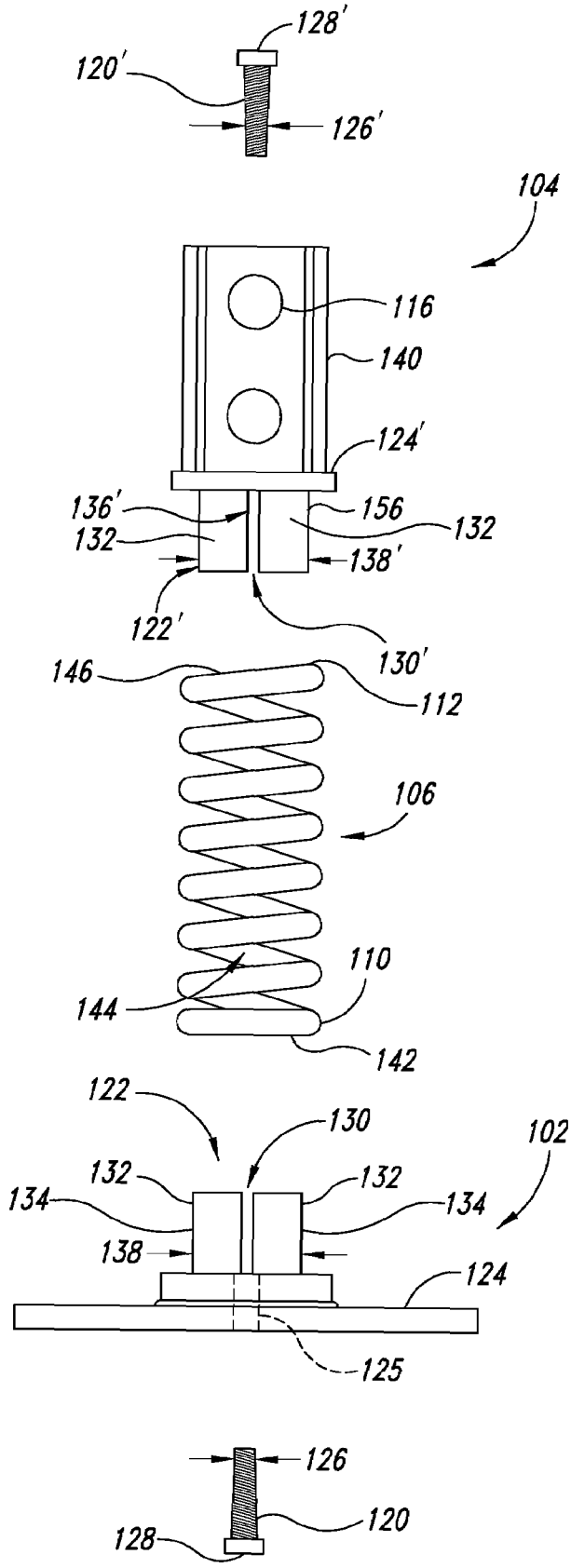
FIG. 4 is an exploded side view of the antenna mount according to the illustrated embodiment of FIG. 1.

FIG. 4 shows an exploded view of the antenna mount 100 of FIG. 1 according to one embodiment. The first end 110 of the resilient member 106 defines an opening 142 to an inner surface 144 of the resilient member 106. The opening 142 and the inner surface 144 are shaped to receive the expandable sleeve 122. Similarly, the second end 112 of the resilient member 106 defines an opening 146 to the inner surface 144.

Figure 5A:
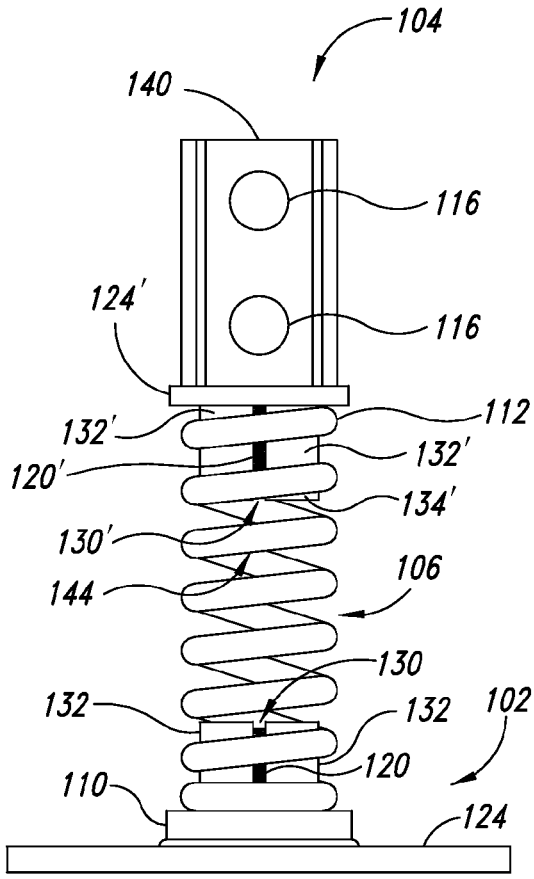
FIG. 5A is a side view of the antenna mount according to the illustrated embodiment of FIG. 1.
Figure 5B:
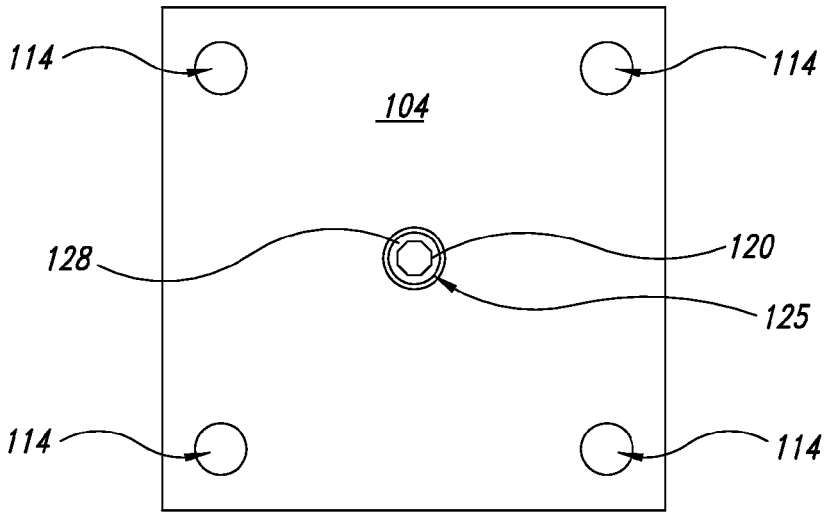
FIG. 5B is a bottom view of the antenna mount according to the illustrated embodiment of FIG. 1.

FIG. 5A shows a side view of the antenna mount 100 according to the embodiment of FIG. 1, and FIG. 5B shows a bottom view of the base 102 of the antenna mount 100 according to the embodiment of FIG. 1.

Referring to FIGS. 4, 5A and 5B, to couple the resilient member 106 to the expandable sleeve 122, the opening 142 of the resilient member 106 is positioned above and aligned with the expandable sleeve 122. The expandable sleeve 122 is inserted into the opening 142 of the resilient member 106. Typically, the elongated members 132 are shaped such that the surface 134 of the elongated members 132 may engage the inner surface 144 of the resilient member 106. Next, the adjustable fastener 120 is aligned with the opening 125 and inserted therein. As the adjustable fastener 120 is inserted into the opening 125, a portion of the adjustable fastener 120 extends into the receptacle 130. As the adjustable fastener 120 extends into the receptacle 130, the adjustable fastener 120 engages an inner surface (not shown) of each of the elongated members 132, thereby pushing the elongated members 132 outward from the receptacle 130 such that the surfaces 134 of the elongated members 132 engage the inner surface 144 of the resilient member 106. The further the adjustable fastener 120 extends into the receptacle 130, the greater the pressure between the expandable sleeve 122 and the resilient member 106.

Coupling the resilient member 106 to the expandable sleeve 122' is accomplished in a similar manner. The opening 146 of the resilient member 106 is positioned below and aligned with the expandable sleeve 122'. The expandable sleeve 122' is inserted into the opening 146 of the resilient member 106. The elongated members 132' are shaped such that the surface 134' of the elongated members 132' may engage the inner surface 144 of the resilient member 106. Next, the adjustable fastener 120' is aligned with the opening 125' and inserted therein. As the adjustable fastener 120' is inserted into the opening 125', a portion of the adjustable fastener 120' extends into the receptacle 130'. As the adjustable fastener 120' extends into the receptacle 130', the adjustable fastener 120' engages an inner surface (not shown) of each of the elongated members 132', thereby pushing the elongated members 132' outward from the receptacle 130' such that the surfaces 134' of the elongated members 132' engage the inner surface 144' of the resilient member 106. The further the adjustable fastener 120' extends into the receptacle 130', the greater the pressure between the expandable sleeve 122' and the resilient member 106.

FIG. 6 shows the antenna mount 100 in operable position according to one illustrated embodiment. The antenna mount 100 is mounted to a surface 302 of a structure 300. The surface 302 has at least two coupling holes (not shown). The two coupling holes are arranged to be aligned with two coupling features 114. Threaded bolts 304 are inserted through two of the coupling features 114 and the two coupling holes formed in the surface 302. The threaded bolts 304 are mated with nuts (not shown) having complementary threads. The nuts are tightened onto the threaded bolts such that the base 102 is coupled to the surface 302. Non-limiting examples of structures 300 include movable structures such as forklifts, floor-jacks, tugs, wagons, carts, vehicles, etc., and stationary structures such as walls, floors, pillars, posts, frames, shelves, door jams, etc.

The antenna assembly 200 having an antenna mounting assembly 202 and an antenna 204 is coupled to the mounting member 104. The antenna mounting assembly 202 includes an arm 206 and a first flange (not shown). The first flange extends generally upward and downward from a first end of the arm 206. The first flange includes at least two coupling holes (not shown) that are aligned with at least two coupling features 116. Threaded bolts 208 extend through the coupling holes and the two coupling features 116. Each one of the threaded bolts 208 receives a nut (not shown), which is threaded complementary to the bolts 208, and the nuts are tightened onto the bolts 208. The antenna 210 is attached to a second end 210 of arm 206.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An antenna mount, comprising:

a base;

a mounting member to support an antenna, wherein the mounting member is a strut;

a resilient member having a first end and a second end, the resilient member physically coupled to the mounting member proximate the first end of the resilient member; and a coupling member physically coupled to the base and physically coupled to the resilient member proximate the second end of the resilient member, wherein the resilient member temporarily deforms in response to a force applied to the mounting member and the coupling member releases the resilient member from the base in response to the force applied to the mounting member being greater than a threshold force.

2. An antenna mount, comprising:

a base;

a mounting member to support an antenna;

a resilient member having a first end and a second end, the resilient member physically coupled to the mounting member proximate the first end of the resilient member; and a coupling member physically coupled to the base and physically coupled to the resilient member proximate the second end of the resilient member, wherein the resilient member temporarily deforms in response to a force applied to the mounting member and the coupling member releases the resilient member from the base in response to the force applied to the mounting member being greater than a threshold force, wherein the threshold force at which the coupling member releases the resilient member is adjustable.

3. An antenna mount, comprising:

a base;

a mounting member to support an antenna;

a resilient member having a first end and a second end, the resilient member physically coupled to the mounting member proximate the first end of the resilient member; and a coupling member physically coupled to the base and physically coupled to the resilient member proximate the second end of the resilient member, wherein the resilient member temporarily deforms in response to a force applied to the mounting member and the coupling member releases the resilient member from the base in response to the force applied to the mounting member being greater than a threshold force, wherein the coupling member is an expansion fastening assembly.

4. The antenna mount of claim 3 wherein the base has an opening formed therein, and a portion of the expansion fastening assembly is received within the opening and forms a frictional engagement therewith.

5. The antenna mount of claim 3 wherein the expansion fastening assembly includes an expandable sleeve having a diameter at least partially received by the resilient member and an adjustable fastener at least partially received by the expandable sleeve and operable to adjust the diameter of the sleeve to adjust an amount of force exerted on the resilient member by the diameter of the expandable sleeve.

6. The antenna mount of claim 5 wherein the expandable sleeve includes at least two elongated members that form a cylindrical assembly having a receptacle therebetween to receive the adjustable fastener.

7. The antenna mount of claim 6 wherein the receptacle is dimensioned to threadedly receive the adjustable fastener.

8. The antenna mount of claim 5 wherein the adjustable fastener is tapered along a longitudinal axis thereof.

9. An antenna mount, comprising:

a base;

an antenna; and coupling means for resiliently and releasably coupling the antenna to the base, wherein the coupling means includes at least one coil spring, and wherein the coupling means includes at least one expansion member physically coupling the coil spring to the base.

10. The antenna mount of claim 9 wherein the at least one expansion member includes a plurality of elongated members arranged to form an outer perimeter and an inner receptacle, the outer perimeter centrally received within the coil spring and the outer perimeter having an adjustable diameter to adjustably engage a portion of the coil spring.

11. An antenna mount, comprising:

a base;

an antenna; and coupling means for resiliently and releasably coupling the antenna to the base, wherein the coupling means includes at least one coil spring and at least one adjustable fastener received in the receptacle and moveable therein to adjust the diameter of the outer perimeter.

12. An antenna mount, comprising:

a base an antenna; and coupling means for resiliently and releasably coupling the antenna to the base, wherein the coupling means includes at least one coil spring and at least one strut to which the antenna is physically attached.

13. A method of mounting an antenna to an object carrying a base, the method comprising:

attaching a mounting member to a resilient member proximate one end of the resilient member such that the resilient member temporarily deforms in response to a force applied to the mounting member;

attaching the resilient member to a coupling member proximate another end of the resilient member;

attaching the resilient member to a portion of a coupling member proximate another end of the resilient member;

adjustably attaching the coupling member to the base such that the coupling member releases the resilient member from the base in response to the force applied to the mounting member being greater than a threshold force, wherein adjustably attaching the coupling member to the base includes adjusting a dimension of an expansion assembly to adjust a force exerted by the expansion assembly on at least one of the resilient member and the base; and attaching an antenna to the mounting member.

14. A method of mounting an antenna to an object carrying a base, the method comprising:

attaching a mounting member to a resilient member proximate one end of the resilient member such that the resilient member temporarily deforms in response to a force applied to the mounting member;

attaching the resilient member to a coupling member proximate another end of the resilient member;

attaching the resilient member to a portion of a coupling member proximate another end of the resilient member;

adjustably attaching the coupling member to the base such that the coupling member releases the resilient member from the base in response to the force applied to the mounting member being greater than a threshold force; and attaching an antenna to the mounting member; and adjustably reattaching the coupling member to the base in response to the release of the resilient member from the base by the coupling member.

15. A method of mounting an antenna to an object carrying a base, the method comprising:

attaching a mounting member to a resilient member proximate one end of the resilient member such that the resilient member temporarily deforms in response to a force applied to the mounting member;

attaching the resilient member to a coupling member proximate another end of the resilient member;

attaching the resilient member to a portion of a coupling member proximate another end of the resilient member;

adjustably attaching the coupling member to the base such that the coupling member releases the resilient member from the base in response to the force applied to the mounting member being greater than a threshold force; and attaching an antenna to the mounting member;

replacing the coupling member with a new coupling member in response to damage to the coupling member; and adjustably reattaching the new coupling member to the base.

* * * * *